United States Patent [19]

Squarci

[11] Patent Number: 4,609,989

[45] Date of Patent: Sep. 2, 1986

[54] METHOD AND MACHINE FOR MANUFACTURING ARTIFICIAL BRANCHES

[75] Inventor: Larry Squarci, Catskill, N.Y.

[73] Assignee: Hudson Valley Tree, Inc., Newburgh, N.Y.

[21] Appl. No.: 596,060

[22] Filed: Apr. 2, 1984

[51] Int. Cl.[4] ..... G06F 15/46; A01N 3/00; A47G 33/04; H01F 11/04

[52] U.S. Cl. ..... 364/468; 428/18; 428/8; 242/7.14; 242/25 A; 242/158 R

[58] Field of Search ..... 428/8, 9, 7, 18, 19, 428/20; 242/7.14, 25 A, 158 R; 57/18; 364/468

[56] References Cited

U.S. PATENT DOCUMENTS

| | | | |
|---|---|---|---|
| 2,157,583 | 5/1939 | Wisoff | 41/1 |
| 2,228,441 | 1/1941 | Cohen | 41/10 |
| 2,335,219 | 11/1943 | Abramson | 41/1 |
| 3,215,047 | 11/1965 | Braun | 93/1.5 |
| 3,244,577 | 4/1966 | Raymond | 161/22 |
| 3,343,357 | 2/1967 | Goodridge | 57/24 |
| 3,478,652 | 11/1969 | Goodridge | 93/1.5 |
| 3,598,337 | 8/1971 | Macke | 242/158 R |
| 3,665,577 | 8/1972 | Dreffenbach | 428/18 X |
| 3,846,212 | 11/1974 | Rodenmund et al. | 428/18 |
| 3,901,016 | 8/1975 | Hurley | 57/18 |
| 4,305,980 | 12/1981 | Spiegel et al. | 428/8 |
| 4,418,523 | 12/1983 | Lemaire | 57/18 |
| 4,480,799 | 11/1984 | Yano et al. | 242/158 R |
| 4,485,978 | 12/1984 | O'Connor | 242/158 R |
| 4,485,981 | 12/1984 | Krywiczanin et al. | 242/58 |

*Primary Examiner*—Jerry Smith
*Assistant Examiner*—Jon D. Grossman
*Attorney, Agent, or Firm*—William L. Botjer

[57] ABSTRACT

A method and device for producing artificial branches from a continuous roll of wire and individual branch tips. The branches tips are attached to the wire by means of wrapping with a filament. In a first embodiment, the wrapping process is started and stopped under control of a stored program computer that measures the amount of wire fed. In a second embodiment, the wire is continuously fed and a wrapping assembly is reciprocated in timed relation with the wire fed to permit the attachment of the individual branch tips.

11 Claims, 2 Drawing Figures

METHOD AND MACHINE FOR MANUFACTURING ARTIFICIAL BRANCHES

BACKGROUND OF THE INVENTION

This invention relates generally to a method of, and machinery for, manufacturing artificial shrubbery such as wreaths and artificial Christmas trees. Specifically, this invention relates to the manufacturing of branches in which individual small branch tips are attached to a rod to form a complete branch by wrapping a filament about the ends of the branch tips and the rod.

A wide variety of methods for manufacturing artificial Christmas trees are known in the art. In one such method, each branch of the tree is composed from a number of smaller branch tips which are joined to a larger branch which, in turn, is mounted to the central pole of the tree. The branch tips are generally made from plastic bristles or strips which extend from a pair of twisted wires so that the branch tip generally resembles a common bathroom brush. In turn, the branch tips are joined to a larger branch which is formed from two larger twisted wires into which the ends of the branch tips are inserted and the wires twisted to secure the branch tips. However, this type of construction suffers from a number of drawbacks. The twisted wire main branch is easily visible and thus it is apparent that the tree is artificial. Furthermore, in this type of construction, the rearward end of each branch tip extends out of the main branch forming a sharp point which is both unsightly and potentially dangerous.

In order to overcome the difficulties of the twisted wire construction for the main branch, a wrapped construction has been used. In the wrapped construction, the main branch, rather than being twisted wire, is a solid rod and the individual branch tips are attached to the rod by having their ends brought in proximity to the rod and then wrapping a filament around the ends to secure the branch tips. The filament is then continuously wrapped around the rod securing the branches at various predetermined points. The many turns of filament wrapped around the rod provides a central branch which appears thicker and thus more natural. Furthermore, the filament may be colored green and brown which covers and hides the metal rod and thus the branch has a more natural appearance.

However, the present methods for manufacturing artificial branches through the wrapping process have also suffered from a number of difficulties. In this method, a straight rod is cut to a predetermined length and marked at various places along its length to indicate to the operator where the branch tips are to be attached. The operator then places the rod in a wrapping machine having a rotating hollow tube which carries about its periphery the filament used for wrapping. The operator places the marked rod in the tube and wraps the tube with filament by manually pulling the rod through the tube until the mark is reached. The rotation of the machine is halted and the individual branch tips attached by the operator. The machine is then restarted and filament wrapped about the tips and rod until the next wrapping point at which point the process is repeated until the branch is complete. Obviously, this procedure requires a relatively large amount of time and many manual operations. Furthermore, the manual wrapping process is wasteful of the wrapping filament. Finallly, pre-cut straight rod is considerably more expensive per foot than the same diameter rod cut and straightened from a large coil of wire.

The present invention is directed towards a method and machine for carrying out an automatic procedure for producing wrapped Christmas tree branches.

SUMMARY OF THE INVENTION

To these ends, first and second embodiments for producing artificial branches from a continuous roll of wire and individual branch tips in an automatic process are provided. In a first embodiment, the device includes a mechanism for feeding the wire through the device. The feeding mechanism is coupled to a motor through a device which permits the feeding to be started and stopped on command. The wire then passes through a rotating spool which wraps a continuous helix of filament about the wire as it is fed. The rotation of the spool is started and stopped in conjunction with the feeding of the wire. A transducer measures the amount of wire being fed through the machine and outputs a signal corresponding thereto. The output of the transducer is connected to the input of a stored program computer whose output starts and stops the feeding and wrapping of the wire in accordance with the program instruction set stored therein. The program sequence in the computer advances the wire in accordance with the length of wire to be fed for each particular branch to be manufactured. When the machine is stopped, the operator may position the branch tip proximate to the rotating spool to be wrapped to the rod.

In a second embodiment of the invention, the feeding of the wire does not have to be stopped and restarted, but rather is a continuous process. The device includes a continuously operated feeding means and a wrapping spool that is both rotating and reciprocable about the length of wire. A transducer outputs a signal representing the amount of wire fed through the machine to a stored program computer. The output of the stored program computer controls the reciprocation of the wrapping spool. Upon command of the computer, the spool will be reciprocated rearwardly to permit the insertion of branch tips to be wrapped, thereafter the rotating spool is reciprocated forwardly to wrap the branches while the rod is continuously advanced. The program instruction set in the computer controls the amount of wire fed between reciprocations of the wrapping spool.

It is accordingly an object of this invention to provide an improved method of manufacturing artificial branches through a wrapping process.

It is another object of this invention to provide improved machinery for producing artificial branches through wrapped attachment of the individual branch tips.

It is another object of this invention to provide artificial branches that are extremely natural in appearance.

It is another object of this invention to provide a high speed wrapping process for the manufacture of Christmas tree branches that requires less manual labor.

It is another object of this invention to manufacture of artificial branches from a continuous wire roll.

Still other objects of this invention will become apparent upon reading of the detailed specification to follow.

DESCRIPTION OF THE PREFERRED EMBODIMENTS

Figure 1:
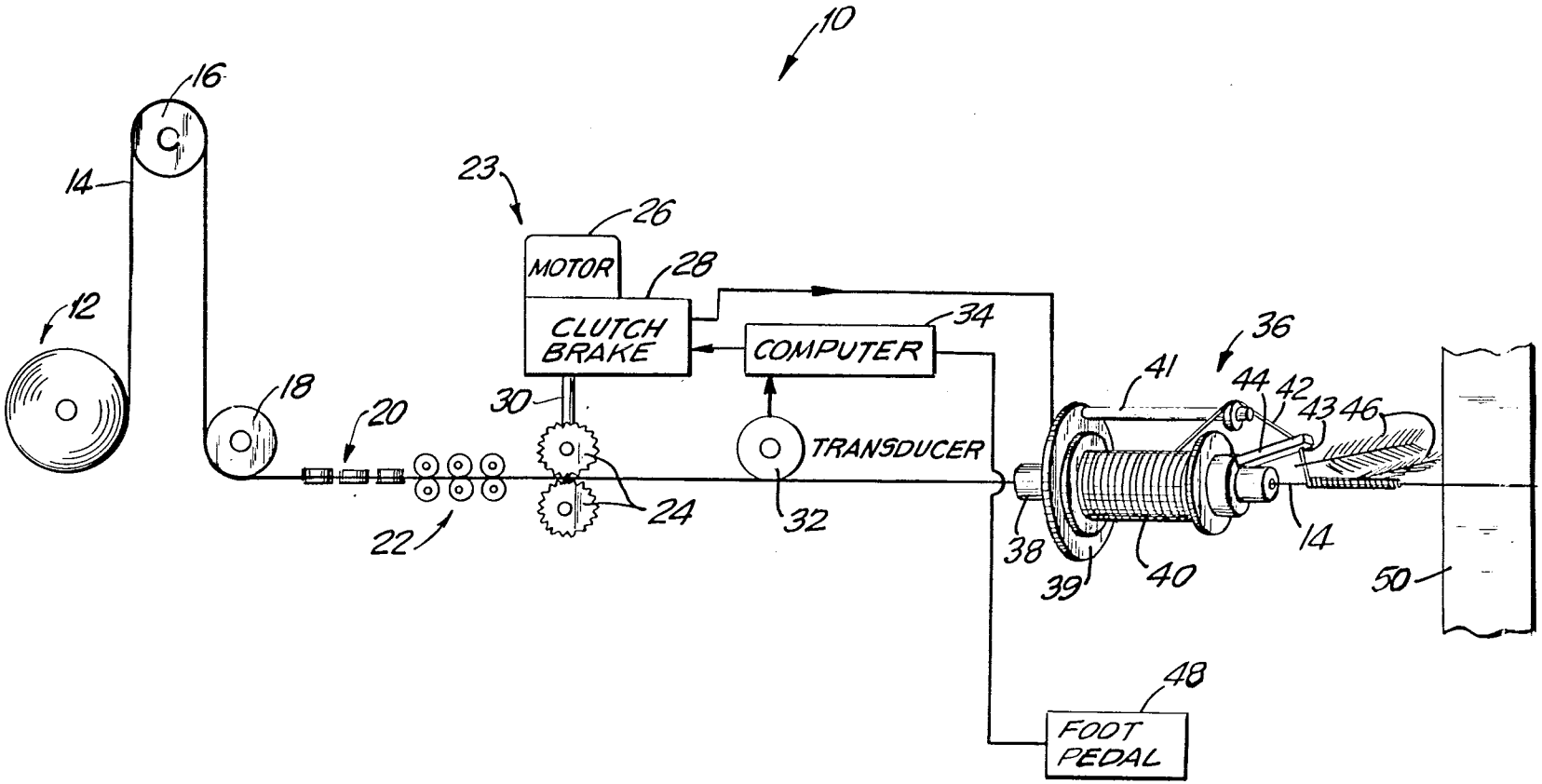

FIG. 1 illustrates a first embodiment of an improved device 10 and method for making artificial shrubbery or tree branches from a continuous roll of wire which forms the main branch to which a series of branch tips are attached at predetermined locations by wrapping with a filament. The branch is constructed from wire 14 fed from a large roll 12 which passes over a first rotatable wheel 16 and under a second rotatable wheel 18. Wire 14 then passes through straightening rollers 20, 22 which comprise a series of rollers tightly engaging each side of wire 14 as it is drawn through device 10. Straightening rollers 20, 22 each comprise multiple rollers arranged half on each side of wire 14. Rollers 20, 22 are arranged perpendicularly with respect to each other to provide a straightened run of wire 14. Wire 14 is driven through device drive 10 by drive mechanism 23. Drive mechanism 23 includes drive gears 24 which are a pair of toothed wheels which tightly engage and displace wire 14. Drive gears 24 are powered by a motor 26 coupled through an electrically activated clutch/brake mechanism 28 and a drive shaft 30. As shaft 30 rotates, the rotation of gears 24 will cause wire 14 to be drawn through device 10. The speed at which gears 24 turn governs the speed at which the wire is drawn through the machine. It should be noted that many other arrangements other than gears 24 may be used to drive wire 14 through drive 10.

In order to control the operation of device 10, it is necessary to know the amount of wire 14 that is being drawn through the device. Accordingly, a feed transducer 32 is provided for measuring the amount of wire fed through. Transducer 32 provides an electrical signal corresponding to the amount of wire 14 drawn through the machine. Transducer 32 is shown as engaging wire 14; however, transducer 32 may act upon any portion of the drive mechanism 23 to provide a measurement of the amount of wire fed through device 10. Transducer 32 may be any of the commercially available transducers for providing an electrical signal in response to mechanical motion.

The output of transducer 32 is fed to the input of a stored program computer 34, the output of which in turn is connected to clutch/brake mechanism 28 to control the stopping and starting of the drive mechanism in accordance with the instructions previously programmed into computer 34 as will be described in detail below.

After transducer 32, wire 14 passes through a rotating spool assembly 36 which rotates either through a mechanical coupling to motor 26 or via its own motor. Spool assembly 36 consists of a rotating hollow shaft 38 through which wire 14 passes on which is mounted a disk 39 and spool of filament 40 for rotation therewith. A strand of filament 42 is played off spool 40 and over arm 41 attached to disk 39 which rotates with spool 40. Filament 42 then passes through an opening 43 in a winding arm 44 attached to shaft 38 which will wind a continuous helix of polyester filament 42 about wire 14 as it passes through. The rotation of spool assembly 36 is controlled so that it is started and stopped with that of drive mechanism 23 so that when the feed of wire 14 is halted via clutch/brake 28, the rotation of spool assembly 36 will also be halted.

The overall operation of the machine is controlled via the program instruction set contained in computer 34 which controls the starting and stopping of drive mechanism 23 and rotating spool assembly 36. The operation of computer 34 will now be described. The computer can be programmed to permit the feed through of a first predetermined amount of wire 14, when computer 34 senses from the output of transducer 32 that the predetermined amount of wire 14 has passed, computer 34 will output a signal to clutch/brake mechanism 28 to disconnect the drive to gears 24 and to halt the rotation of spool 36.

The operator of the machine, who is positioned at the end of spool assembly 36, may then pick up a branch tip 46 or a number of branch tips 46 as is required by the type of branch to be produced and will place same proximate to the portion of filament 42 being wound about wire 14. After the branch tips 46 have been positioned, drive mechanism 23 and spool assembly 36 will be restarted either under the control of computer 34 or through an operator controlled foot pedal 48. Spool assembly 36 will then wrap filament 42 about the ends of branch tip 46 and wire 14 which will join branch tips 46 to wire 14. Wire 14 is fed through and after another predetermined amount of wire has been fed, drive gears 24 and spool assembly 36 will again be halted. It should be noted that the amount of wire 14 fed between each cycle need not be uniform. The spacing is set by the programmable instruction set of computer 34 which is easily changeable. For example, each program sequence can comprise feeding through of three groups of differing amounts of feed to permit the attachment of three sets of branches thereafter, a longer playout of wire 14 is programmed to form the end of the individual branch.

A conveyor 50 may be disposed near the operator to bring a supply of branch tips 46 to the operator and to remove completed branches. After the branch has been completed, the individual branch is then cut off either manually or automatically by device 10 and the cycle restarted under the control of computer 34. Should a different size, type of length of branch be desired, a different program instruction set is programmed into computer 34. Thus, the operator of the machine need not be concerned with the positioning of branch tips 46 on wire 14. The appropriate distance will be measured out and the device will be halted at the proper position. The branch tips inserted and the machine then restarted.

The device illustrated in FIG. 1 provides high speed manufacturing of artificial branches from a roll of wire without the necessity for the operator to measure the points at which the branches are to be attached. However, in operation, the feed of the wire through the machine is stopped and started. It is desirable for even higher speed production to provide a device which includes all of the advantages of the device of FIG. 1, while permitting continuous feed of the wire. The device illustrated in FIG. 2 is such a continuous feed device.

Figure 2:
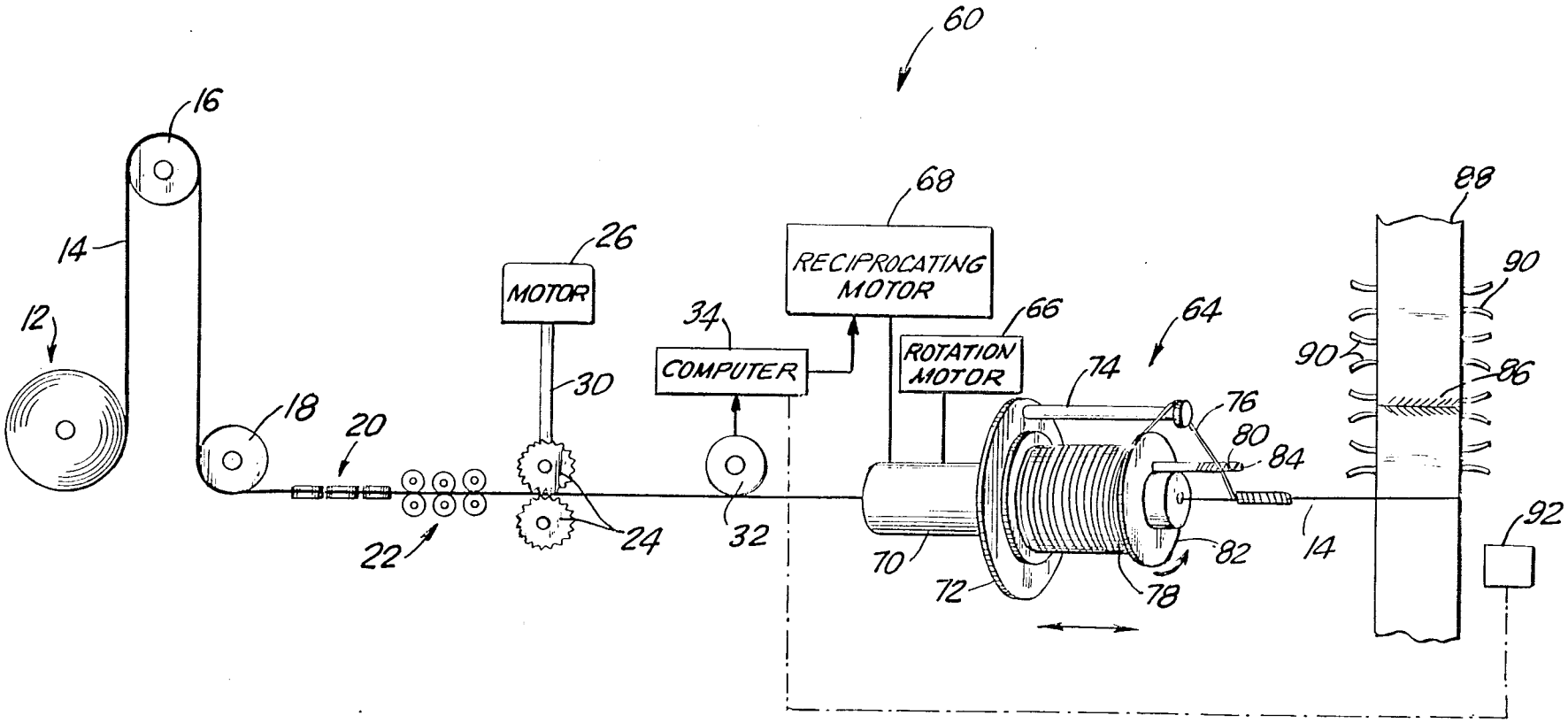

FIG. 2 illustrates a device 60 and method for manufacturing artificial shrubbery or Christmas trees. In FIG. 2, the same reference numerals have been used to designate the same elements as set forth with respect to the embodiment illustrated in FIG. 1. Briefly summarized, a length of wire 14 fed from a large coil 12 passes over and under wheels 16 and 18 and through straightening rollers 20, 22 to provide a straightened length of wire 14. Wire 14 is drawn through the machine by drive gears 24 coupled to motor 26. In this embodiment, it is to be noted that motor 26 need not include a clutch/brake mechanism as the feed in this device is continuous and is not stopped and started during the normal operation of the machine.

Transducer 32 again measures the amount of wire 14 fed through device 60 and outputs an electrical signal representing the amount of wire fed to stored program computer 34. Wire 14 then passes to a spool assembly 64 which is both rotatable about wire 14 and reciprocable backwards and forwards along the longitudinal axis of wire 14. The rotation of spool assembly 64 may be controlled either by a separate motor 66 or through suitable coupling to motor 26. The reciprocation of spool assembly 64 is caused by a reciprocating motor 68 which has a control input connected to computer 34.

Spool assembly 64 is disposed on a hollow shaft 70 through which wire 14 passes and which is both rotatable and slideable on any suitable bearings. Spool assembly 64 includes a first rotating disc 72 which has a forwardly extending arm 74 or arms over which a polyester wrapping filament 76 passes. Filament 76 is unwound from a spool 78 which rotates with spool assembly 64. A winding arm 80 mounted for rotation with shaft 70 includes an opening 84 through which filament 76 passes. The rotation of spool assembly will cause filament 76 to unwind from spool 78 and the rotation of arm 84 will wind a continuous helix of filament 76 about rod 14.

In order to permit insertion of and wrapping of branch tips 86 to rod 14 while wire 14 is being advanced, spool assembly 64 is reciprocated forwards and backwards. When spool assembly 64 is in its rearmost position, the operator, standing at the end of spool assembly 64, may pick up branch tips 86 from a conveyor 88 and place them between arm 84 and wire 14. When spool assembly 64 is displaced to its forward position, filament 76 will engage the ends of branch tips 84 and will wrap the filament about the ends of branch tips 84 for attachment to wire 14. After attachment of branch tips 84, spool assembly 64 will be reciprocated rearwardly and wire 14 will continue to feed through for a predetermined amount under the control of computer 34. When a suitable amount of wire 14 has been fed as measured by transducer 32, computer 34 will output a signal to energize reciprocating motor 68 to displace spool assembly 64 forwardly where the operator will have positioned another branch tip 86 for wrapping by filament 76. Again the amount of wire fed through the device is under the control of the instruction set programmed into computer 34 and thus, the amount of wire fed before spool assembly 64 is reciprocated and may be varied in accordance with the type of branch to be manufactured. Merely by changing the instruction set, different types of branches can be produced in a continuous fashion without the need for any special skill on the part of the operator.

FIG. 2 also illustrates a conveyor system 88 suitable for use with the device 60. Conveyor 88 delivers branch tips towards device 60 and includes a series of branch tip holders 90 which comprise a pair of upstanding rods located on each side of conveyor 88. The appropriate number of branch tips 86 may be placed in each holder 90. The amount of branch tips placed in each holder 90 may be varied in accordance with the type of branch to be produced and, thus, will be positioned properly for lifting and attachment to rod 14. Furthermore, in order to synchronize the operation of conveyor 88 with device 60, a position sensor 92 may be positioned so as to be contacted by branch tip holders 90. Position sensor 92 has an output coupled to computer 34 to indicate branch tips 90 are in position to begin the reciprocation cycle of spool assembly 64. Furthermore, a suitable mechanical lifting mechanism can be utilized to lift the branch tips from conveyor 88 into position for wrapping by arm 84, without the need for an operator, thus completely automating the manufacturing process. After the wrapping of each individual branch is complete, the individual branch is cut off either manually or by an automatic process under the control of computer 34.

In this description, the stored program control computer has been operated by electrical inputs. However, it should be noted that the sequencing of events could be controlled by a suitable mechanical arrangement without departing from the spirit of the invention. The stored program computer need not be of any particular type as any computer capable of responding to an input and sequencing machinery may be used. Such computers are readily commercially available from a number of manufacturers. For example, a suitable computer is a programmable counter which is connected to a feed transducer comprising a photoelectric cell disposed alongside any suitable drive gear, as the gear teeth pass the photocell pulses corresponding to the amount of wire feed are output to and counted by the counter. Furthermore, the various motors utilize power and the device described herein could be either electrical or hydraulic.

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and the appended claims.

What is claimed is:

1. A device for manufacturing artificial branches from a continuous coil of wire and individual branch tips by wrapping with a continuous filament comprising:

means for feeding said wire through said device;

motor means driving said feeding means;

means for starting and stopping the feeding of said wire;

rotating spool means for mounting said continuous filament of wrapping material, said wire being fed through said rotating spool, said rotating spool including means for wrapping said filament about said wire, said spool being rotated as said wire is fed and being stopped when said feeding means are stopped;

transducer means for measuring the amount of wire being fed through said device, said transducer means including an output corresponding to the amount of wire fed through said device; and a stored program computer having an input coupled to said transducer means and an output coupled to said starting and stopping means to stop and restart said feeding means and said rotating spool means in timed relation to the amount of fed wire through said device to thereby permit an operator to position said branch tips proximate to said wire for securing said tips to said wire by wrapping with said filament.

2. The device as claimed in claim 1, wherein said feeding of said wire is restarted under operator control.

3. The device as claimed in claim 1, further including conveyor means for delivering said branch tips to said operator.

4. The device as claimed in claim 1, further including straightening means acting upon said wire before said wire passes through said feed means.

5. The device as claimed in claim 1, wherein said means for starting and stopping said feed comprise clutch/brake means disposed between said motor and said feeding means.

6. The device as claimed in claim 1, further including straightening means acting upon said wire before said wire passes through said feed means.

7. A device for manufacturing artificial branches from a continuous coil of wire and individual branch tips by wrapping with a continuous filament comprising:

means for feeding said wire through said device;

transducer means for measuring the amount of wire being fed through said device, said transducer means providing an output corresponding to the amount of wire fed through said device;

rotating spool means having said continuous filament wound thereon, said wire being fed through said rotating spool, said rotating spool including means for wrapping said filament about said wire;

means for reciprocating said spool means longitudinally about said wire; said spool being reciprocated from a first rearward position to permit said branch tips to be positioned proximate to said wrapping means to a second forward position to wrap said filament about said proximately positioned branch tip and said wire to thereby secure said branch tip to said wire; and a stored program computer having an input coupled to said transducer means and an output coupled to said reciprocating means to reciprocate said spool assembly between said first and said second position in timed relation to the amount of material being fed through said device.

8. The device as claimed in claim 7, further including conveyor means for delivering said branch tips to said device.

9. The device as claimed in claim 8 wherein said conveyor includes means for holding a predetermined number of said branch tips in spaced array.

10. A method for manufacturing artificial branches from a coil of wire and individual branch tips comprising:

providing a continuous supply of said wire;

feeding said wire;

measuring the amount of wire being fed;

winding a continuous wrapping of filament about said wire;

stopping said feeding and said winding at predetermined points in accordance with the amount of wire measured;

positioning said branch tips proximate said wire; and restarting said feeding and said winding to wrap said branch tips securely to said wire.

11. A method for manufacturing artificial branches from a coil of wire and individual branch tips comprising:

providiing a continuous supply of said wire;

feeding said wire;

measuring the amount of wire being fed;

winding a continuous wrapping of filament from a spool disposed around said wire; and reciprocating said winding spool at predetermined points in accordance with the amount of wire measured to permit the positioning of branch tips proximate to said wire to attach said branch tips to said wire by said wrapping of said filament.

* * * * *